US005239932A

United States Patent [19]

Weber

[11] Patent Number: 5,239,932

[45] Date of Patent: Aug. 31, 1993

[54] FORCE DAMPENING MECHANISM OF A RAILROAD CAR TRUCK

[75] Inventor: Hans B. Weber, Rotonda West, Fla.

[73] Assignee: National Castings Inc., Lisle, Ill.

[21] Appl. No.: 898,707

[22] Filed: Jun. 15, 1992

[51] Int. Cl.[5] ..... B61F 5/50

[52] U.S. Cl. ..... 105/198.2

[58] Field of Search ..... 105/198.2, 198.4, 198.5, 105/197.05

[56] References Cited

U.S. PATENT DOCUMENTS

| | | | |
|---|---|---|---|
| 2,277,263 | 3/1942 | Tucker | 105/198.2 |
| 3,548,754 | 12/1970 | Williams | 105/198.2 |
| 3,690,270 | 9/1972 | Gutmann et al. | 105/198.4 |
| 3,834,320 | 9/1974 | Tack | 105/198.2 |
| 4,254,712 | 3/1981 | O'Neil | 105/198.5 |
| 5,176,083 | 1/1993 | Bullock | 105/198.2 |

*Primary Examiner*—Mark T. Le

[57] ABSTRACT

A new improved mechanism is described for dampening forces between the sideframes and bolster of a railroad car truck or bogie. The mechanism comprises a pair of triangularly shaped wedges which are positioned between a pair of wear plates carried by each of the sideframes and an adjacent pair of inclined wear plates which are disposed in a pair of wedge pockets which are formed adjacent each of the opposing ends of the bolster. The inclined wear plates of the bolster are bolted, in place, rather than being conventionally welded. Space is provided for the nuts and bolts by removing and redirecting the top side of the bolster, adjacent the inclined wear plates, to intersect the inclined wear plate in the area of line contact between the inclined wear plate and adjacent curved surface of the wedge to buttress or reinforce the slotted bolster in this area.

5 Claims, 1 Drawing Sheet

FORCE DAMPENING MECHANISM OF A RAILROAD CAR TRUCK

BACKGROUND OF THE INVENTION

The invention relates to railroad cars, especially the trucks or bogies which are located at opposing ends of a railroad car to support the car on the rails of a trackway. More particularly, the invention relates to a truck which is manufactured and sold by National Castings Incorporated of Lisle, Ill. under the trademark SWING MOTION. A detailed description of this quality truck with excellent high speed performance characteristics is found in U.S. Pat. No. 3,670,660. The SWING MOTION truck is manufactured from many different steel parts, such as a bolster and transom which are coupled between a pair of sideframes between which a pair of axles with attached wheels are mounted in parallel relation for rotation about the longitudinal axes of the axles as the wheels roll along the rails of the trackway. Adjacent each of the opposing ends of the bolster are a pair of wedge pockets with oppositely sloped surfaces which are designed to engage a pair of spring loaded wedges which interact between the sideframe and bolster end to dampen undesirable motion of the sideframes and prevent it from being transmitted to the bolster and attached railroad car, such motion being caused, for example, by wavy or misaligned rails of the trackway. The invention is directed to the improvement of this motion dampening mechanism.

Briefly stated, the invention is in strengthening and improving the durability of the wedge contacting surfaces of the bolster, as will hereinafter be explained in greater detail.

DESCRIPTION OF THE DRAWING

The following description of the invention will be better understood by having reference to the accompanying drawing, wherein.

DETAILED DESCRIPTION OF THE DRAWING

Figure 1:
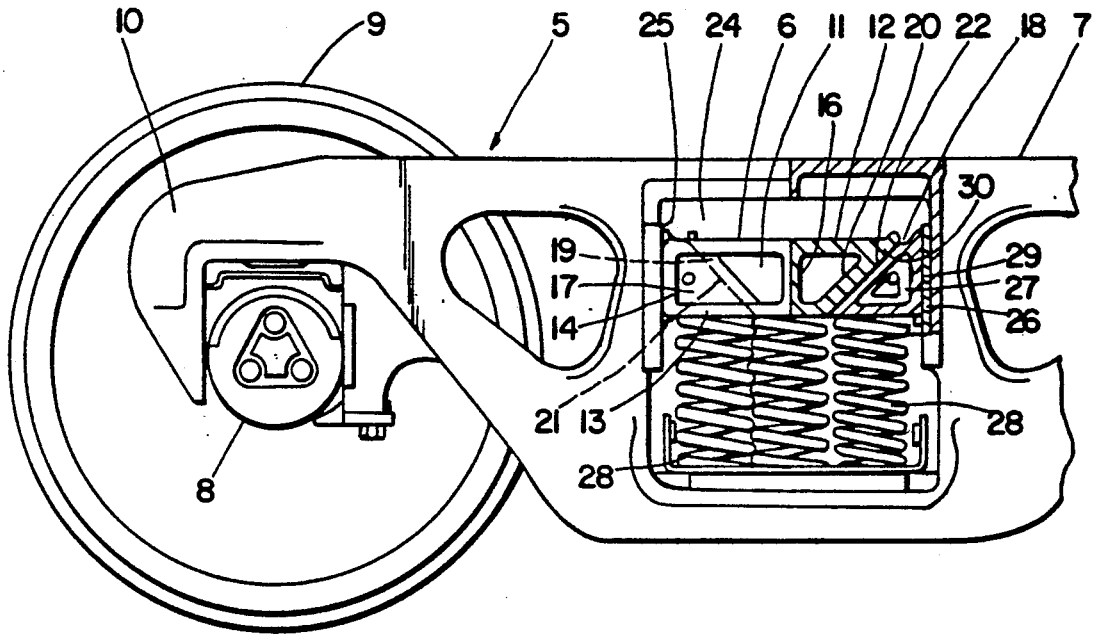
Fig. 1 (PRIOR ART)
FIG. 1 is a side view of part of a sideframe of a SWING MOTION truck as it is presently made, with a portion removed to show a part of the motion dampening mechanism, in section.

With general reference to the drawing for like parts and particular reference to FIG. 1, there is shown a railroad car truck or bogie 5 which, for explanation purposes, is in a horizontal position. The truck 5 essentially comprises a bolster 6 which is transversely coupled between a pair of similar, but oppositely disposed parallel sideframes 7. An axle 8 with a pair of attached wheels 9, is mounted between each pair of opposing pedestals 10 of the sideframes 7, for rotation about the longitudinal axis of axle 8.

The bolster 6 has a pair of longitudinally spaced opposing ends 11 which are generally hollow and of similar design, including a flat, horizontal top side 12 in parallel relation above a flat bottom side 13, a pair of flat, vertical sides 14 and 15 (FIG. 2) connecting the ends of the top and bottom sides 12 and 13, and a vertical reinforcing web 16 secured between the top and bottom sides 12 and 13 midway between the connecting sides 14 and 15. A pair of similar, but oppositely shaped wedge pockets 17 and 18 are recessed in the connecting sides 14 and 15 in equally spaced, aligned relation from each end 11 of the bolster 6. Each pair of wedge pockets 17 and 18 have a pair of oppositely sloped or inclined walls 19 and 20 with flat, outer surfaces 21 and 22 7hich converge in a downward direction away from the top wall 12 of the bolster end 11. Each of the wedge pockets 17 and 18 includes a pair of flat side walls, e.g. side wall 23, which extend horizontally from each one of the inclined surfaces 21 and 22 in parallel directions from the longitudinal axis of the bolster 6.

Each one of the bolster ends 11 extends through an opening 24, which is formed in an adjacent sideframe 7 midway between the opposing ends 10 of the sideframe 7. The opening 24 in each one of the sideframes 7, is defined between a pair of spaced, flat, vertical wear plates 25 and 26 which are secured to the sideframe 7 in confronting relation. The wear plates 25 and 26 of each one of the sideframes 7 are disposed in confronting, spaced relation from the adjacent inclined surfaces 21 and 22 of each pair of adjacent wedge pockets 17 and 18 to complete or enclose the triangular shaped wedge pockets 17 and 18, except for an open bottom end.

A triangular shaped, spring loaded, friction wedge 27 is positioned in each one of the wedge pockets 17 and 18 to essentially complete the motion dampening mechanism which is designed to eliminate or substantially reduce the transmission of undesirable motion from the sideframes to the bolster and attached railroad car caused, for example, by wavy or misaligned rails of a railroad trackway. A strong, vertical coil spring 28 coacts between each one of the friction wedges 27 and the adjacent sideframe 7 to maintain the wedges 27, in position. Each one of the friction wedges 27 has a flat, vertical surface 29 for frictionally engaging the adjacent wear plate 26 carried by the sideframe 7, and a bowed or crowned surface 30 (FIG. 2) which is smoothly curved outwardly towards the adjacent inclined surface 22 of the pocket 18, so as to make line contact with the inclined surface 22 transversely of the friction wedge 27.

A one-quarter inch thick wear plate (not shown in FIG. 1) is presently welded to each one of the inclined surfaces 21 and 22 of the bolster pockets 17 and 18, to strengthen and improve the durability of the inclined surfaces 21 and 22 which engage the friction wedges 27. However, this has proven to be unsatisfactory, since the welds which hold the dissimilar metals of the wear plate and bolster together, usually crack such that the wear plates eventually fall off.

Figure 2:
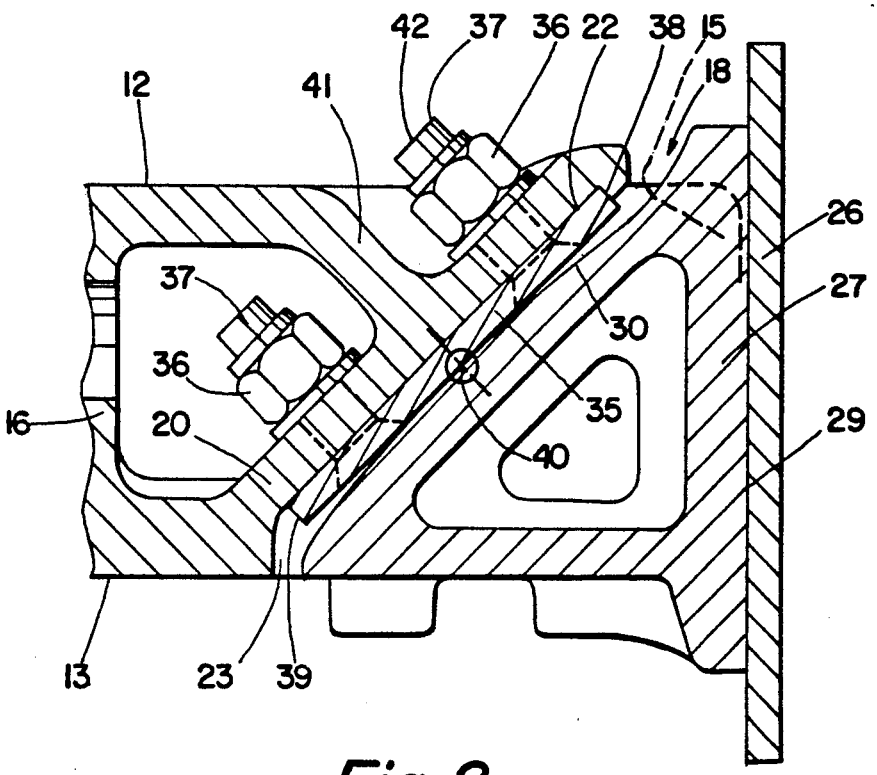
FIG. 2 is an enlarged section showing the improved motion dampening mechanism of the invention.

FIG. 2 is an enlarged cross-section of the wedge pocket 18, but is illustrative of the invention, as applied to any friction wedge and pocket. Therefore, the following detailed description of the invention will be in relation to wedge pocket 18, as seen in FIG. 2, wherein a three-eights inch thick, flat wear plate 35 is bolted, not welded, to the inclined surface 22 of the bolster pocket 18. A plurality of threaded nuts 36 and countersunk flat headed bolts 37 are used, adjacent the upper and lower ends 38 and 39 of the bolted wear plate 35, to firmly secure the wear plate 35, in place. The bolts 37 are on opposite sides of the anticipated line contact, indicated at 40, between the curved surface 30 of the friction wedge 27 and the adjacent, bolted wear plate 35. It can be appreciated by those skilled in the design and production of railroad car trucks or bogies, that it would be practically impossible to bolt the vertically uppermost end 38 of the bolted wear plate 35 in position, when the conventional bolster pocket 18 of FIG. 1 is used, because of the tight fit between the top side 12 of the bolster end 11 and the inclined walls 19 and 20 of the wedge pockets 17 and 18.

In the new improved friction wedge pocket 18, the top side 12 of the bolster end 11, between the opposing sides, e.g. side 23, of the wedge pocket 18 terminates short of the adjacent end of the inclined wall 22 and then angles or extends downward towards the friction wedge 27 to join the inclined wall 22 at right angles in the area of the line contact 40 between the friction wedge 27 and the bolted on wear plate 35. This provides ample space on the inclined wall 22 above the angled top side 41 to accommodate a nut 36 and bolt 37 and its placement and removal.

This unique angling of the top side 12 of the bolster end 11 adjacent each one of the wedge pockets 17,18, provides the space necessary to bolt the wear plates 35 securely to the inclined walls 19,20, while reinforcing the inclined walls 19,20, in the area of contact with the spring loaded friction wedges 27. The flat bolt heads are countersunk so that they won't interfere with the contact between the friction wedges 27 and the bolted on wear plates 35. Moreover, the bolts 37 are sufficiently spaced from the line 40 of contact to insure that such interference doesn't happen.

Thus, there has been described a new and improved motion dampening mechanism for the SWING MOTION truck, or any other truck of similar design which uses friction wedges as part of the motion dampening mechanism. The wedge pockets of the bolster are strengthened at the point of contact with the friction wedges, and the wear plates within the bolster pockets are firmly bolted and not welded to the adjacent sloped or inclined surfaces confronting the curved contacting surface of the friction wedges. An added benefit is that the wear plates in the bolster pockets can be unbolted when they become worn and replaced with new wear plates.

What is claimed is:

1. A railroad car truck which, when horizontally disposed, comprises:

a) a pair of parallel sideframes, each of the sideframes having a pair of vertical wear plates in confronting, spaced relation midway between longitudinally spaced opposing ends of the sideframe, the confronting wear plates of each sideframe defining an opening between them;

b) a bolster disposed between the sideframes in transverse relation, such that the longitudinal axis of the bolster is generally normal to the sideframes, the bolster having a pair of longitudinally spaced opposing ends which extend between the confronting wear plates of the sideframes, the ends of the bolster each having a generally horizontal top side in parallel relation above a bottom side which is connected to the top side by a pair of opposing, parallel sides, the bolster having a pair of oppositely shaped wedge pockets at each end thereof, each pair of wedge pockets being in confronting spaced relation from the vertical wear plates of an adjacent sideframe, each of the wedge pockets defined between a pair of flat side walls which extend in parallel relation from a flat, inclined wall which is angularly disposed to a vertical plane, the inclined walls of each pair of wedge pockets converging in a direction away from the top side of an adjacent end of the bolster, the top side of each end of the bolster terminating short of adjacent closest ends of the inclined walls of the bolster pockets and angled downward between the flat side walls of the wedge pockets into abutting relation with the inclined walls of the wedge pockets between opposing ends of the inclined walls and in normal relation to the inclined walls to reinforce the inclined walls and form on the inclined walls, a space on opposing sides of each abutting angled top side sufficient to receive a nut and bolt;

c) a wear plate bolted to the inclined wall of each pocket by a plurality of bolts and threadably engaged nuts located in the spaces on either side of the abutting angled top side of the bolster, each of the wear plates having a flat, outer surface which is exposed in the pocket; and d) a spring loaded, triangularly shaped friction wedge disposed in each one of the wedge pockets between the confronting wear plates of a sideframe and adjacent inclined wall, each of the wedges having, i) a vertical, flat surface for frictionally engaging the adjacent wear plate of a sideframe, and ii) a curved surface which curves outwardly from the vertical flat surface of the wedge in a direction toward a confronting inclined wear plate for line contact with the inclined wear plate in the area where the angled top side of the bolster abuts the inclined wall of the wedge pocket, between the spaces on either side of the angled top side and the nuts and bolts in such spaces.

2. The railroad car truck of claim 1, wherein each of the bolts has a frustum conically shaped flat head which is countersunk in the wear plate, such that the flat head of each bolt does not extend beyond the outer flat surface of the wear plate.

3. A railroad car truck which, when horizontally disposed, comprises:

a) a wedge pocket formed by a flat inclined wall which is angularly disposed at an included acute angle to a flat vertical wall;

b) means for securing a first, flat wear plate to the vertical wall in confronting relation to the inclined wall;

c) means for mounting a second, flat wear plate on the inclined wall in confronting relation to the first wear plate, including a plurality of bolts and attached nuts disposed in a pair of aligned bolt holes which are vertically spaced in the second wear plate and inclined wall;

d) means for reinforcing the inclined wall, joined at an angle to the inclined wall and located between the pair of aligned bolt holes; and e) a spring loaded wedge disposed in the wedge pocket, the wedge having, i) a first, flat surface frictionally engaging the first wear plate, and ii) a second surface which is smoothly curved outwardly in a direction away from the first surface of the 7edge, and which contacts the second wear plate along a line which is between the pair of bolt holes, in the area of the means for reinforcing the inclined wall, and which line is transversely disposed to a line connecting the pair of aligned bolt holes.

4. The raiload car truck of claim 3, wherein the inclined wall reinforcing means includes a third flat plate integrally formed with the inclined wall and extending therefrom at a right angle.

5. The railroad car truck of claim 4, wherein each one of the pair of bolts has a conically shaped flat head which is countersunk in the second wear plate.

* * * * *